US009892714B2

(12) United States Patent
Mese et al.

(10) Patent No.: US 9,892,714 B2
(45) Date of Patent: Feb. 13, 2018

(54) BRIGHTNESS CONTROL METHOD, APPARATUS AND PROGRAM PRODUCT

(71) Applicant: Lenovo (Singapore) Pte. Ltd., New Tech Park (SG)

(72) Inventors: John Carl Mese, Cary, NC (US); Nathan J. Peterson, Durham, NC (US); Russell Speight VanBlon, Raleigh, NC (US); Rod D. Waltermann, Rougemont, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 151 days.

(21) Appl. No.: 14/746,420

(22) Filed: Jun. 22, 2015

(65) Prior Publication Data

US 2015/0287389 A1 Oct. 8, 2015

Related U.S. Application Data

(63) Continuation-in-part of application No. 13/535,992, filed on Jun. 28, 2012, now abandoned.

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0606* (2013.01); *G09G 2320/0626* (2013.01); *G09G 2360/144* (2013.01)

(58) Field of Classification Search
CPC ..... G09G 2320/0606; G09G 5/30
See application file for complete search history.

(56) References Cited

U.S. PATENT DOCUMENTS 7,605,829 B2 * 10/2009 Oh ..... G09G 3/3406 345/594
8,269,802 B2 * 9/2012 Fujine ..... G09G 5/00 345/102

(Continued)

FOREIGN PATENT DOCUMENTS

EP 1503363 2/2005
WO 2008026066 A1 3/2008

(Continued)

OTHER PUBLICATIONS

Jason Gilbert, "Galaxy S4 Features: All The New Things That Samsung's Latest Smartphone Can Do",Huffington Post, Mar. 14, 2013. http://www.huffingtonpost.com/2013/03/14/galaxy-s4-features-samsung-smartphone_n_2878956.html.

*Primary Examiner* — Yuehan Wang
(74) *Attorney, Agent, or Firm* — John L. Rogitz; John M. Rogitz

(57) ABSTRACT

A method, apparatus and program product which enable a user selected display brightness to be linked to an application program selected for use in an electronic device such as a computer system, tablet, telephone, electronic book reader, game device, music playing device and the like. A user selected adjustment of display brightness for an application program and a then existing ambient lighting condition are stored in storage during use of the application program. In response to subsequent opening of an application program for which data has been stored, the stored data is accessed and display brightness relative to the ambient lighting condition present at the subsequent opening is given the previous, stored, user selected adjustment.

20 Claims, 5 Drawing Sheets

(56) References Cited

U.S. PATENT DOCUMENTS

| | | | | |
|---|---|---|---|---|
| 8,872,753 | B2 | 10/2014 | Glen | |
| 2004/0183765 | A1 | 9/2004 | Morisawa | |
| 2004/0207613 | A1 | 10/2004 | Morisawa | |
| 2005/0017994 | A1 | 1/2005 | Oh | |
| 2007/0273714 | A1* | 11/2007 | Hodge | G09G 3/20 345/690 |
| 2008/0055228 | A1 | 3/2008 | Glen | |
| 2008/0165115 | A1 | 7/2008 | Herz et al. | |
| 2008/0192140 | A1 | 8/2008 | Lee et al. | |
| 2011/0035552 | A1* | 2/2011 | Heynen | G06F 3/0481 711/126 |
| 2011/0071352 | A1* | 3/2011 | Ozawa | A61B 1/0638 600/109 |
| 2011/0095875 | A1 | 4/2011 | Thyssen et al. | |
| 2012/0001960 | A1 | 1/2012 | Herz et al. | |
| 2012/0218320 | A1 | 8/2012 | Evanicky et al. | |
| 2013/0221855 | A1 | 8/2013 | Lazaridis et al. | |
| 2013/0235073 | A1 | 9/2013 | Jaramillo et al. | |

FOREIGN PATENT DOCUMENTS

| | | |
|---|---|---|
| WO | 20080260696 | 3/2008 |
| WO | 2010070721 | 6/2010 |

* cited by examiner

100

41
ROM
Boot Code
40
System Processor(s)
42
Processor Bus
44
Host Bridge
48
System Memory
46
Graphics Adapter
68
68
PCI Local Bus
60
Network Adapter
66
Local PCI Controller
62
Memory Bus
64
NVRAM
38
Host Bridge
80
Disk Controller
72
Disk Drive
70
ISA Bridge
64
ISA Bus
62
I/O Controller
72
Serial Port
Parallel Port
Keyboard / Mouse

BRIGHTNESS CONTROL METHOD, APPARATUS AND PROGRAM PRODUCT

FIELD AND BACKGROUND

A user's experience with electronic devices such as computer systems, tablets, telephones, electronic book readers, game devices, music playing devices and the like is impacted by the brightness of the display provided. Many such devices provide ambient light condition sensors and circuitry and executing program code which adjust brightness in response to variations in such ambient lighting. Many such devices accept or provide program code enabling a range of activities such as word processing, internet access and searching, data capture for purposes of downloading program code and data such as web sites or electronic publications.

A user in exercising such program code, here as in common usage called application programs, may find that display brightness provided by the device is not the best for their individual viewing. For that reason, it is commonplace for the program code provided with or in the device to enable user adjustment of display brightness. Usually such functionality is provided at the operating system code level. Using this functionality, a user may adjust the display brightness while using an application program to adapt the device to the user's preferences. However, such adjustments are made for each application program and each time that the application program is initiated.

SUMMARY

What is disclosed and taught in the description which follows are a method, apparatus and program product which enable a user selected display brightness to be linked to an application program selected for use in a device of the types mentioned above. In particular, a user selected adjustment of display brightness for an application program and a then existing ambient lighting condition are stored in storage during use of the application program. In response to subsequent opening of an application program for which data has been stored, the stored data is accessed and display brightness relative to the ambient lighting condition present at the subsequent opening is returned to the previous, stored, user selected adjustment.

The details of present principles, both as to their structure and operation, can best be understood in reference to the accompanying drawings, in which like reference numerals refer to like parts, and in which:

BRIEF DESCRIPTION OF DRAWINGS

Some purposes having been stated, others will appear as the description proceeds, when taken in connection with the accompanying drawings, in which.

DETAILED DESCRIPTION

Figure 1:
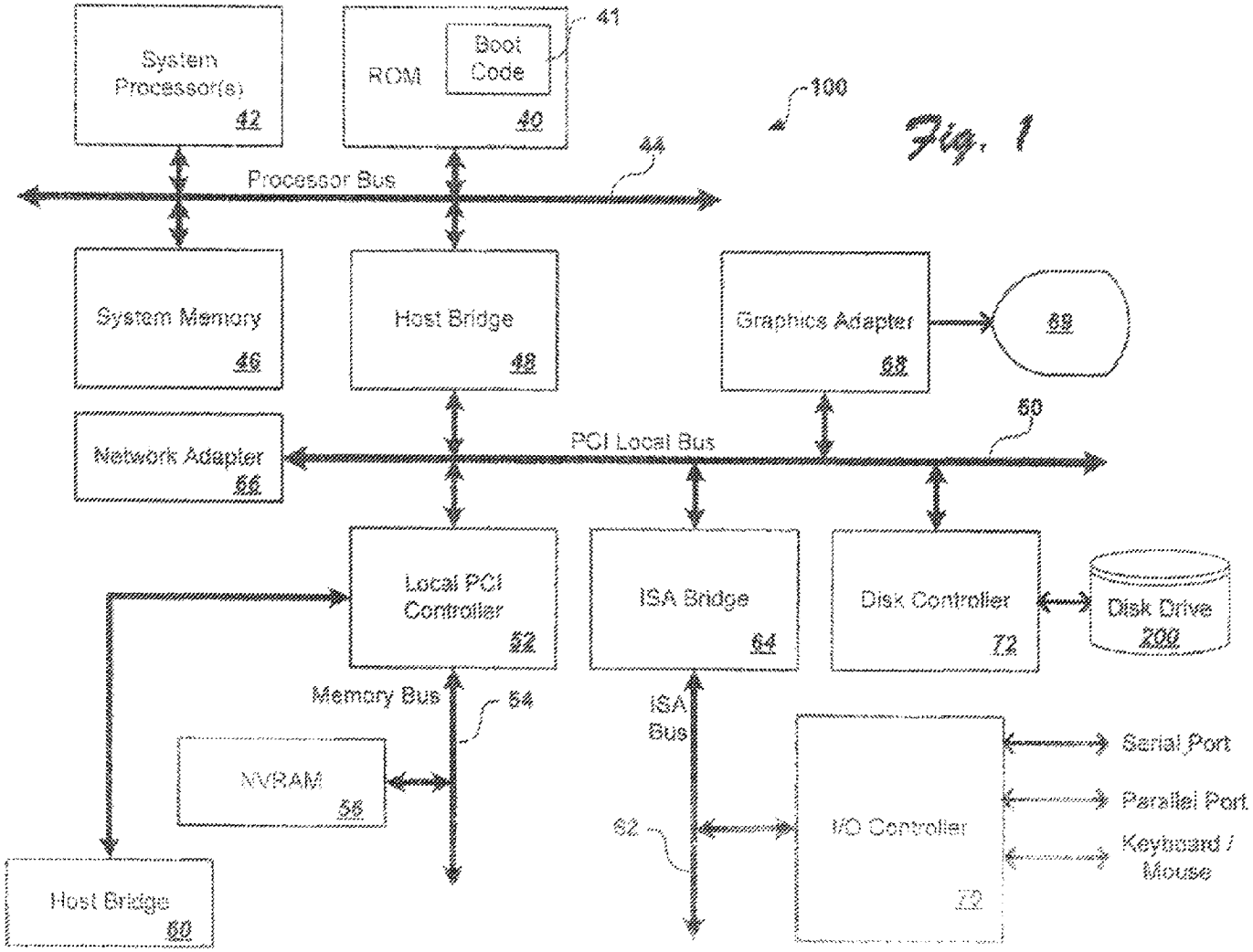
FIG. 1 is an example of a computer system in which the technology described here may be implemented.

This disclosure relates generally to device-based information. With respect to any computer systems discussed herein, a system may include server and client components, connected over a network such that data may be exchanged between the client and server components. The client components may include one or more computing devices including televisions (e.g., smart TVs, Internet-enabled TVs), computers such as desktops, laptops and tablet computers, so-called convertible devices (e.g., having a tablet configuration and laptop configuration), and other mobile devices including smart phones. These client devices may employ, as non-limiting examples, operating systems from Apple, Google, or Microsoft. A Unix or similar such as Linux operating system may be used. These operating systems can execute one or more browsers such as a browser made by Microsoft or Google or Mozilla or other browser program that can access web applications hosted by the Internet servers over a network such as the Internet, a local intranet, or a virtual private network.

As used herein, instructions refer to computer-implemented steps for processing information in the system. Instructions can be implemented in software, firmware or hardware; hence, illustrative components, blocks, modules, circuits, and steps are set forth in terms of their functionality.

A processor may be any conventional general purpose single- or multi-chip processor that can execute logic by means of various lines such as address lines, data lines, and control lines and registers and shift registers. Moreover, any logical blocks, modules, and circuits described herein can be implemented or performed, in addition to a general purpose processor, in or by a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

Any software and/or applications described by way of flow charts and/or user interfaces herein can include various sub-routines, procedures, etc. It is to be understood that logic divulged as being executed by, e.g., a module can be redistributed to other software modules and/or combined together in a single module and/or made available in a shareable library.

Logic when implemented in software, can be written in an appropriate language such as but not limited to C# or C++, and can be stored on or transmitted through a computer-readable storage medium (e.g., that may not be a transitory signal) such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and twisted pair wires. Such connections may include wireless communication connections including infrared and radio.

In an example, a processor can access information over its input lines from data storage, such as the computer readable storage medium, and/or the processor can access information wirelessly from an Internet server by activating a wireless transceiver to send and receive data. Data typically is converted from analog signals to digital by circuitry between the antenna and the registers of the processor when being received and from digital to analog when being transmitted. The processor then processes the data through its shift registers to output calculated data on output lines, for presentation of the calculated data on the device.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

"A system having one or more of A, B, and C" (likewise "a system having one or more of A, B, or C" and "a system having one or more of A, B, C") includes systems that have A alone, B alone, C alone, A and B together, A and C together, B and C together, and/or A, B, and C together, etc.

The term "circuit" or "circuitry" is used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions.

While the present technology will be described more fully hereinafter with reference to the accompanying drawings, in which preferred embodiments are shown, it is to be understood at the outset of the description which follows that persons of skill in the appropriate arts may modify what is here described while still achieving the favorable results contemplated. Accordingly, the description which follows is to be understood as being a broad, teaching disclosure directed to persons of skill in the appropriate arts, and not as limiting upon the scope of the claims.

Referring now to FIG. 1, what is there shown and will be here described is an example of an electronic apparatus, in particular a computer system, useful in practicing this technology. It will be understood by knowledgeable readers that computer systems vary in complexity, size and capability. The showing and description here should thus be understood as an example only. It is contemplated that the techniques will be implemented through the available range of computing apparatus and related devices as mentioned above.

FIG. 1 is a block diagram of a computer system 100 according to an embodiment of the present technology which incorporates at least one system processor 42, which is coupled to a Read-Only Memory (ROM) 40 and a system memory 46 by a processor bus 44. System processor 42 is general-purpose processor that executes boot code 41 stored within ROM 40 at power-on and thereafter processes data under the control of operating system and application programs stored in system memory 46. System processor 42 is coupled via processor bus 44 and host bridge 48 to Peripheral Component Interconnect (PCI) local bus 50.

PCI local bus 50 supports the attachment of a number of devices, including adapters and bridges. Among these devices is network adapter 66, which interfaces computer system 100 to LAN 10, and graphics adapter 68, which interfaces computer system 100 to display 69. Communication on PCI local bus 50 is governed by local PCI controller 52, which is in turn coupled to non-volatile random access memory (NVRAM) 56 via memory bus 54. Local PCI controller 52 can be coupled to additional buses and devices via a second host bridge 60.

Computer system 100 further includes Industry Standard Architecture (ISA) bus 62, which is coupled to PCI local bus 50 by ISA bridge 64. Coupled to ISA bus 62 is an input/output (I/O) controller 70, which controls communication between computer system 12 and attached devices such as a keyboard, mouse, a disk controller 72, and a disk drive. In addition, I/O controller 70 supports external communication by computer system 100 via serial and parallel ports.

Figure 2:
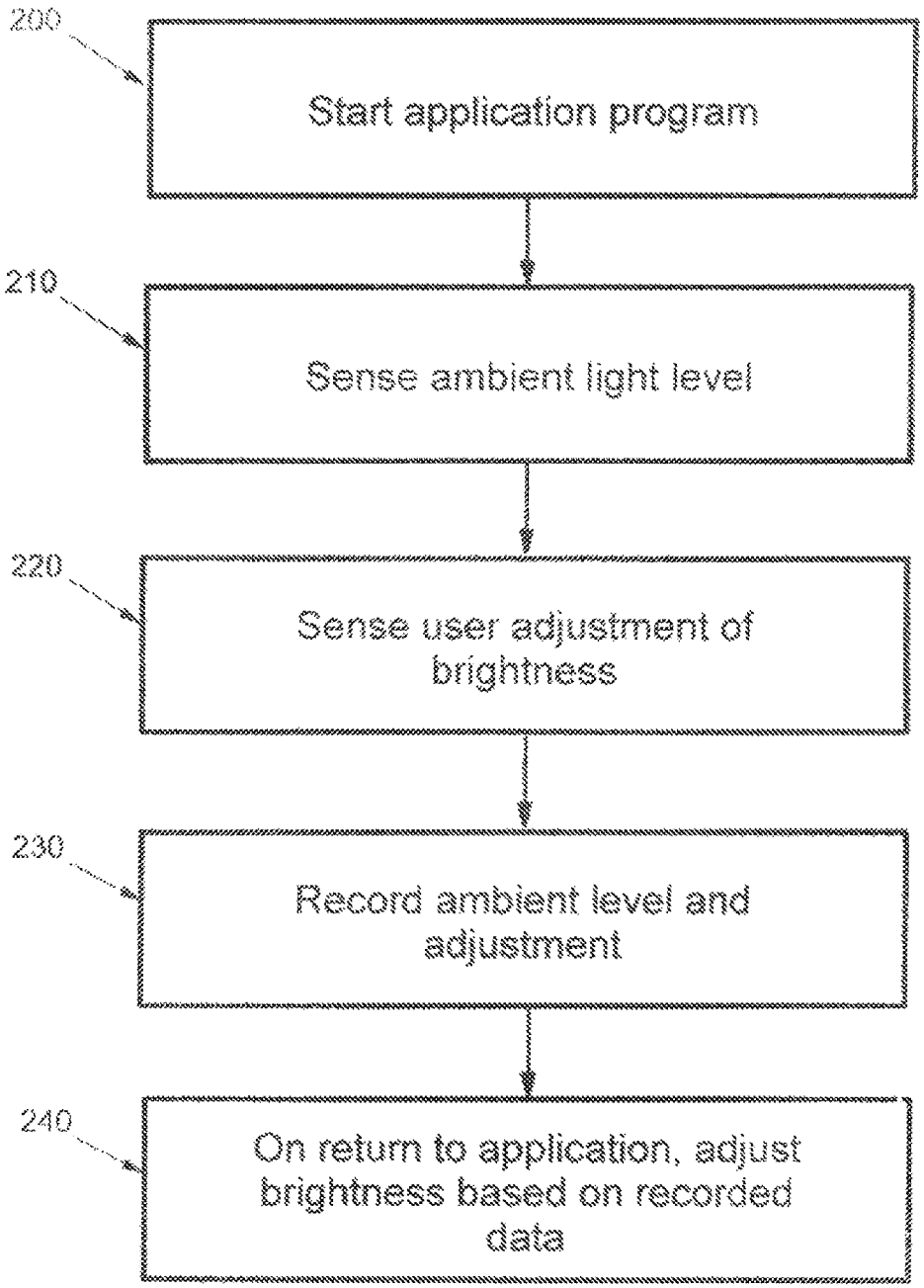
FIG. 2 is a flow chart showing an implementation of the technology here described.

Referring now to FIG. 2, a sequence which follows the execution of the method of this technology in an apparatus of the types described is there shown. On a user starting an application program (200), the device used will sense ambient light conditions (210). In the event that the user makes any adjustment of the brightness level of the display, toward increased or decreased brightness, that adjustment is sensed (220). The ambient light conditions existing at startup of the application program and the user adjust of brightness are recorded in the device memory in a form accessible to the device processor, such as a data base of application programs, sensed ambient conditions, and sensed user adjustments (230). On a return to use of the application program at some later time, display brightness will be adjusted to the recorded user preference taking into account the ambient lighting conditions at the time of return to the program (240).

User adjustment may be done in a number of varying ways, depending on choices made available through the operating system design. In one embodiment, the user adjustment may be by steps, such as an increase or decrease by 10%, 20%, 30% etc. In an alternate embodiment, the user adjustment may be along a continuum, with simple selection of a point along a range of from dim to very bright. In yet another embodiment, the user adjustment may be as a percentage of ambient light sensed. Further, in any of these embodiments the user adjustments, which may vary from time to time regardless of ambient lighting conditions due to variations in user preference, can be gathered over the passage of time, resulting in generation of a light curve unique to each application program and applied automatically. As the user continues to make adjustments, the light curve becomes more accurate increasing viewer comfort and potentially lowering the discharge rate of any battery supporting operation of the device. It is contemplated that, in response to opening of an application program for which data defining any user selected adjustment of display brightness is absent, the device will select a brightness level appropriate to the then present ambient lighting condition. Should the user then make an adjustment in display brightness, then the process described here would begin.

Figure 3:
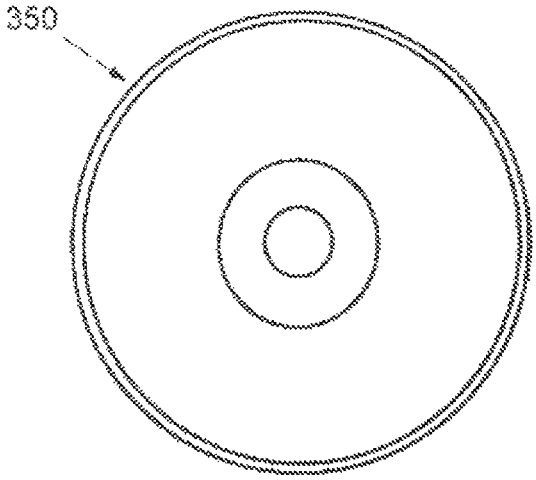
FIG. 3 is a representation of a tangible computer readable medium bearing executable program code which will implement the techniques here described.

Referring now to FIG. 3, one or more aspects of the present technology can be included in an article of manufacture (e.g., one or more computer program products) having, for instance, tangible computer usable media, indicated at 350 in FIG. 3. The media has embodied therein, for instance, computer readable program code for providing and facilitating the capabilities of the methods and apparatus described. The article of manufacture can be included as a part of a computer system or sold separately. Machine readable storage mediums may include fixed hard drives, optical discs such as the disc 350, magnetic tapes, semiconductor memories such as read only memories (ROMs), programmable memories (proms of various types), flash memory, etc. The article containing this computer readable code is utilized by executing the code directly from the storage device, or by copying the code from one storage device to another storage device, or by transmitting the code on a network for remote execution.

Figure 4:
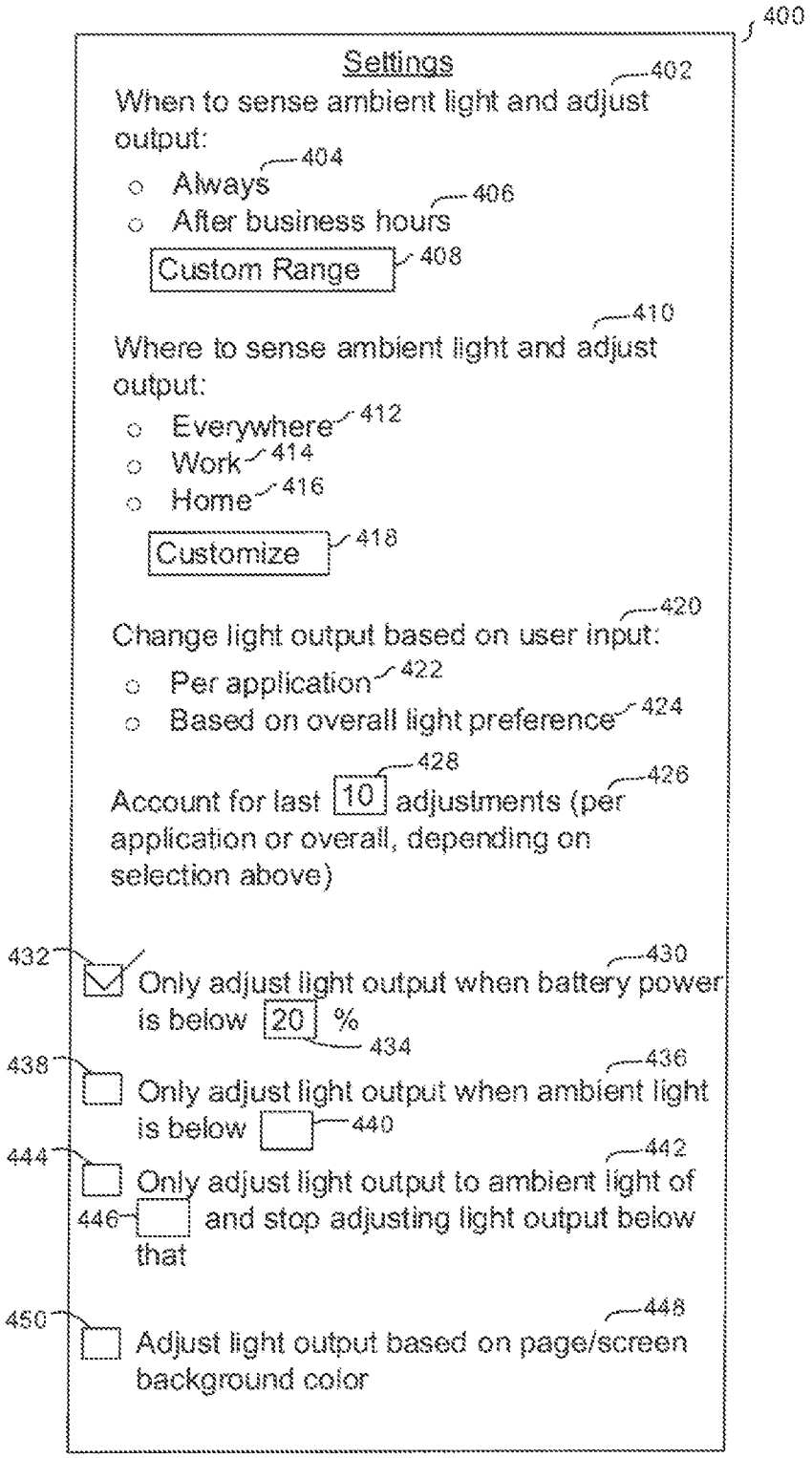
FIGS. 4-5 are example user interfaces presentable on a display in accordance with present principles.

Continuing the detailed description in reference to FIG. 4, it shows an example user interface (UI) 400 presentable on a display of a device undertaking present principles. The UI 400 includes a first setting 402 for providing input indicating times at which the device is to sense ambient light and/or adjust display brightness output in accordance with present principles. Thus, a first option 404 is selectable by a user (e.g., based on touch input and/or cursor-based input) to always sense ambient light and adjust display brightness when, e.g., a user initiates an application. A second option 406 is also shown which is selectable by a user to, e.g., upon launch of an application, sense ambient light and/or adjust display brightness output when the user input to launch is received after business hours (e.g., times other than Monday through Friday, 9 a.m. to 5 p.m. on regular business days). Furthermore, note that the setting 402 includes a custom range selector 408 which is selectable to cause another option and/or UI to be presented at which a user may enter a custom range(s) for when the device is to sense ambient light and/or adjust display brightness output as set forth herein.

The UI 400 also includes a second setting 410 for providing input indicating locations at which the device is to sense ambient light and/or adjust display brightness output in accordance with present principles. Thus, a first option 412 is selectable by a user to sense ambient light and adjust display brightness everywhere when, e.g., a user initiates an application. A second option 414 is also shown which is selectable by a user to, e.g., upon launch of an application, sense ambient light and/or adjust display brightness output when the user input to launch is received while the device is at a "work" location (e.g., the user's place of business). The setting 410 also includes a third option 416 which is selectable to sense ambient light and/or adjust display brightness output when the user input to launch is received while the device is at a "home" location (e.g., the user's personal residence). Furthermore, note that the setting 410 includes a customize selector 418 which is selectable to cause another option and/or UI to be presented at which a user may specify one or more other locations at which the device is to sense ambient light and/or adjust display brightness output as set forth herein.

Still in reference to FIG. 4, the UI 400 also includes a setting 420 for configuring the device to change display brightness output at a per-application level (e.g., the user may configure different brightness outputs for the display for when and/or while different applications are presented) by selecting option 422, or to change display brightness output based on a universal preference and/or ambient light, but not based on a particular application launched and/or presented, by selecting option 424.

The UI 400 also includes a setting 426 for setting a threshold number of past adjustments (e.g., stored in a history or database on the device) to use when and/or while the device is to sense ambient light and/or adjust display brightness output as set forth herein. Accordingly, a number entry box 428 is presented for the option 426 at which a user may enter a number to establish the threshold number of past adjustments the device is to use. In the present instance, a user has configured the device to use the ten past, most recent adjustments.

The UI 400 may include still other options. For instance, an option 430 is selectable using check box 432 to, when selected, only adjust display brightness output in accordance with present principles when and/or while battery power has fallen to or below a threshold percentage of (e.g., total) battery charge remaining (e.g., while also not engaged with a power source for charging). Thus, a number entry box 434 is included for the option 430 at which a user may enter and/or select a number to establish the threshold percentage.

An option 436 may also be included that is selectable using check box 438 to, when selected, only adjust display brightness output in accordance with present principles when and/or while ambient light at and/or near the device is below a threshold amount. Thus, a number entry box 440 is included for option 436 at which a user may enter and/or select a number to establish the threshold amount of ambient light.

Still further, an option 442 may be included on the UI 400 that is selectable using check box 444 to, when selected, only adjust display brightness output in accordance with present principles when and/or while ambient light at and/or near the device is above a threshold amount and to stop adjusting display brightness output when the ambient light level is below this threshold amount. Thus, a number entry box 446 is included for option 442 at which a user may enter and/or select a number to establish this threshold amount for ambient light.

Additionally, the UI 400 of FIG. 4 may include an option 448 that is selectable using check box 450 to, when selected, adjust display brightness output in accordance with present principles based on one or more colors on a UI, window, page and/or screen (e.g., of an application) being viewed (e.g., in addition to adjusting display brightness based on other factors as disclosed herein, such as ambient light and past user adjustments), such as adjusting display brightness output based on one or more background colors specifically. For instance, the device may determine that a home page, UI, and/or screen of an application being launched has a white background and/or white content (e.g., a majority and/or threshold amount of white background or content based on pixel count and/or percentage of display area on which electronic data is presentable), and hence brightness of the display output need not be as bright as for another page, window, UI, and/or screen of a different application that when presented upon launch of the different application has a black background or majority black content. Furthermore, present principles are understood to not be limited to black and white backgrounds and content, and that display brightness output may be adjusted incrementally, e.g., from low to high output based on colors from relatively bright to relatively dark such as from white to black with other colors from a color scale included therebetween. For instance, such a color scale may include, e.g., from relatively bright to relatively dark: white, gray, and black (e.g., for a black and white scale); or white, yellow, green, dark purple, and black.

Figure 5:
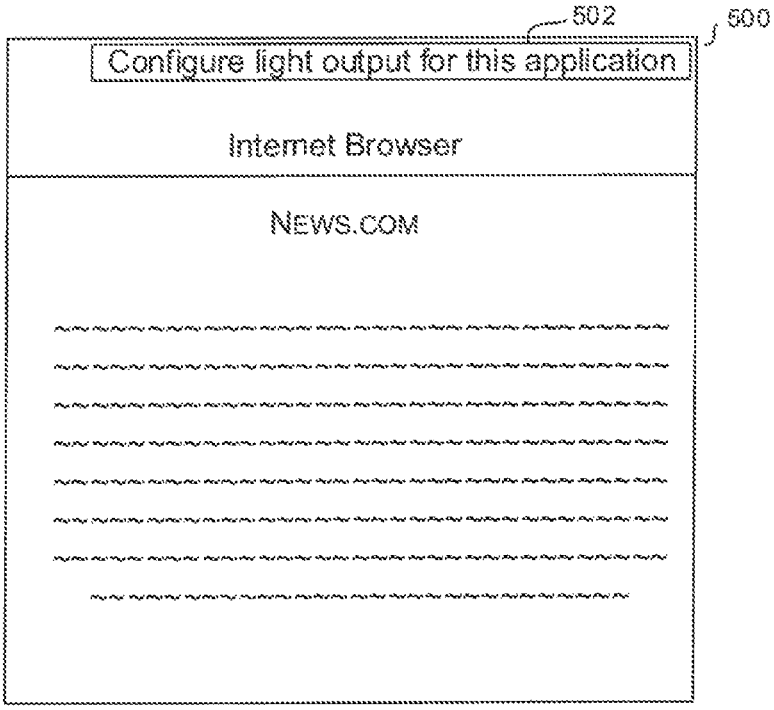

Before moving on to the description of FIG. 5, it is to also be understood that a weighting may be assigned to each factor for adjusting display brightness output, such as to adjusting display brightness output proportionally more based on ambient light and past user adjustments than based on a background color of a screen to be presented and/or already presented. The weighting may be set by a user using be UI 400 such as at option 448 once selected (even though such an option is not shown in FIG. 4 for simplicity), where each factor may be listed on the UI 400 and include a number entry box adjacent thereto at which a use may enter a weight for the associated factor. The weighting may be based on percentage (e.g., to adjust display output 45% based on ambient light, 45% based on past user adjustments, and 10% based on background color), and/or based on a level of importance using a scale from one to ten or from one to a number corresponding to the number of factors listed on the UI 400.

Continuing now in reference to FIG. 5, it shows an example UI 500 presentable on a display of a device undertaking present principles. The UI 500 is understood to be associated with an application accessible to the device and/or stored thereon. In this example, the UI 500 is associated with an Internet browser application. Note that the UI 500 includes a selector 502 selectable to automatically without further user input cause the device to present a UI for configuring one or more adjustments to display brightness output in accordance with present principles. Thus, in one example embodiment, selection of the selector 502 automatically without further user input causes the device to present the UI 400 described above and/or at least one of the features of the UI 400 discussed above, such as options 430, 436, and 442.

Before concluding, it is to be understood that although a software application for undertaking present principles may be vended with a device undertaking present principles, present principles also apply in instances where such an application is downloaded from a server to a device over a network such as the Internet. Furthermore, present principles apply in instances where such an application is included on a computer readable storage medium that is being vended and/or provided, where the computer readable storage medium is not a transitory signal and/or a signal per se.

While the particular BRIGHTNESS CONTROL METHOD, APPARATUS AND PROGRAM PRODUCT is herein shown and described in detail, it is to be understood that the subject matter which is encompassed by the present application is limited only by the claims.

What is claimed is:

1. A device, comprising:

a processor;

a display accessible to the processor; and storage accessible to the processor and bearing instructions executable by the processor to:

store at least data pertaining to respective user adjustments of display brightness for different applications and data pertaining to existing ambient lighting conditions while the respective user adjustments were made; and in response to an opening of a respective application of the different applications, access the data pertaining to respective user adjustments of display brightness for different applications and the data pertaining to existing ambient lighting conditions while the respective user adjustments were made; and adjust current display brightness for the display at least in part based on the data pertaining to respective user adjustments of display brightness for different applications, the data pertaining to existing ambient lighting conditions while the respective user adjustments were made, and at least one color of a user interface (UI) associated with the respective application;

wherein the current display brightness is adjusted at least in part based on respective weights associated with user adjustment of display brightness, existing ambient lighting condition(s), and color of at least a portion of a UI; and wherein the weights are associated with a scale from one to a variable, wherein the variable corresponds to a number of factors to be weighted, the factors at least comprising: user adjustment of display brightness, existing ambient lighting condition(s), and color of at least a portion of a UI.

2. The device of claim 1, wherein the instructions are executable to:

present on the display at least a first user interface (UI) at which at least one setting associated with display brightness may be configured, wherein the first UI is presented in response to selection of a selector presented on a second UI, the second UI associated with at least one respective application of the different applications.

3. The device of claim 1, wherein the current display brightness is adjusted at least in part based on at least one color of a background of the UI.

4. The device of claim 3, wherein the current display brightness is adjusted at least in part based on at least one color that constitutes a threshold amount of all background color of the background of the UI.

5. The device of claim 4, wherein the threshold amount is a threshold number of pixels.

6. The device of claim 4, wherein the threshold amount is a threshold percentage.

7. The device of claim 1, wherein the current display brightness is adjusted at least in part based on at least one color of a home page associated with the respective application that is presented in response to an opening of the respective application.

8. The device of claim 7, wherein the current display brightness is adjusted at least in part based on at least one color of a background of a home page associated with the respective application that is presented in response to an opening of the respective application.

9. The device of claim 1, wherein the instructions are executable by the processor to:

adjust the current display brightness for the display at least in part based on time of day such that display brightness is adjusted during a first time of day but is not adjusted during a second time of day different from the first time of day.

10. A computer readable storage medium (CRSM) that is not a transitory signal, the computer readable storage medium comprising instructions executable by a processor of a device to:

adjust display brightness for a display accessible to the processor at least in part based on data pertaining to at least one ambient lighting condition; and adjust display brightness for the display at least in part based on time of day such that display brightness is adjusted during a first time of day but is not adjusted during a second time of day different from the first time of day.

11. The CRSM of claim 10, wherein the first and second times of day are specified by a user based on input to a user interface (UI) presented on the display.

12. The CRSM of claim 10, comprising the device, wherein the device is coupled to the CRSM, the device comprising the processor and the display.

13. The CRSM of claim 10, wherein the instructions are executable by the processor to:

adjust display brightness for the display at least in part based a current location of the device.

14. The CRSM of claim 13, wherein the current location is a first location, and wherein the instructions are executable by the processor to: decline to adjust display brightness for the display at least in part based on the device being located at a second location that is different from the first location.

15. The CRSM of claim 14, wherein the first and second locations are specified by a user based on input to a user interface (UI) presented on the display.

16. A method, comprising:

adjusting display brightness for a display accessible to a processor of a device at least in part based on data pertaining to at least one ambient lighting condition; and adjusting display brightness for the display at least in part based on time of day such that display brightness is adjusted during a first time of day but is not adjusted during a second time of day different from the first time of day.

17. The method of claim 16, wherein the first and second times of day are specified by a user based on input to a user interface (UI) presented on the display.

18. The method of claim 16, comprising:

presenting at least a first user interface (UI) on the display that comprises at least a first selector that is selectable to without further user input cause a second UI to be presented on the display at which at least setting associated with display brightness may be configured.

19. The method of claim 16, wherein display brightness is adjusted at least in part based on respective weights associated with ambient lighting condition(s) and a first color of at least a portion of a UI, wherein the first color constitutes a threshold amount of all colors of the UI, and wherein the threshold amount is a threshold percentage of display area used to present the UI.

20. The method of claim 16, wherein display brightness is adjusted at least in part based on respective weights associated with ambient lighting condition(s) and time of day.

* * * * *